United States Patent [19]

Randolph

[11] 4,212,333

[45] Jul. 15, 1980

[54] QUICK FILL/EMPTY TANK CAR SYSTEM

[75] Inventor: Robert W. Randolph, St. Charles, Mo.

[73] Assignee: ACF Industries, Incorporated, New York, N.Y.

[21] Appl. No.: 967,107

[22] Filed: Dec. 7, 1978

[51] Int. Cl.[2] ..... B65B 3/04

[52] U.S. Cl. ..... 141/98; 141/113; 141/231; 141/302; 141/349; 104/1 R; 105/1 A; 251/149.6; 406/145; 414/378

[58] Field of Search ..... 141/113, 98, 231–233, 141/285–302, 346–356, 59, 206–229, 198, 94–96; 104/1; 105/1 A; 414/376, 377, 378; 406/145; 251/149, 149.6

[56] References Cited

U.S. PATENT DOCUMENTS

| | | | |
|---|---|---|---|
| 3,125,135 | 3/1964 | Boyer et al. | 141/293 |
| 3,563,287 | 2/1971 | Ruddick | 141/113 |
| 3,604,478 | 9/1971 | Gowens | 141/293 |
| 4,040,456 | 8/1977 | Defrees | 141/113 |

*Primary Examiner*—Houston S. Bell, Jr.
*Attorney, Agent, or Firm*—Henry W. Cummings

[57] ABSTRACT

An automatic bottom load and unload railway tank car includes a tank body having a quick fill and unload lading valve in the tank bottom. A vent valve is also located in the tank bottom and a vent conduit extends from the vent valve up to the top of the tank to a tank vent located in the top of the tank. At a tank car loading and unloading site, the tank car is spotted over an actuating assembly located between and below the tracks. The actuating assembly includes a lading valve actuator and a vent valve actuator which move upwardly and engage the tank bottom to open the lading valve and the vent valve. A lading conduit is connected to the lading loading and unloading valve and to a storage container. A vent conduit is connected between the vent valve and the upper portion of a storage container. During loading, lading passes from the storage container through the lading valve into the tank, and air and vapors pass from the tank to the top of the storage container. During unloading, lading passes from the tank car through the lading valve into the container, and air and vapors enter the car through the vent conduit from the atmosphere or from the top of the container. After the car is loaded and/or unloaded, the actuating assembly is returned to a retracted position below the tracks.

14 Claims, 7 Drawing Figures

QUICK FILL/EMPTY TANK CAR SYSTEM

BACKGROUND OF THE INVENTION

U.S. Pat. Nos. 1,542,116; 3,675,670; 3,722,556; 3,897,807; 3,906,995; 3,989,059; 4,002,192; and 4,007,766 disclose the use of interconnected railway tank cars used to transport large quantities of liquid lading, particularly liquid petroleum, from place to place.

In these patents, interconnected tank cars are loaded and unloaded simultaneously by connecting a loading or unloading conduit to one end car and sequentially loading or unloading the remaining cars. This construction is expensive in requiring connections between adjacent cars, valves at each end of the cars, and controls for opening and closing these valves.

SUMMARY OF THE INVENTION

An automatic bottom load and unload railway tank car includes a tank body having a quick fill and unload lading valve in the tank bottom. A vent valve is also located in the tank bottom, and a vent conduit extends from the vent valve up to the top of the tank to a tank vent located in the top of the tank. At a tank car loading and unloading site, the tank car is spotted over an actuating assembly located between and below the tracks. The actuating assembly includes a lading valve actuator and a vent valve actuator which move upwardly and engage the tank bottom to open the lading valve and the vent valve.

A lading conduit is connected to the lading loading and unloading valve and to a storage container; and a vent conduit is connected between the vent valve and the upper portion of the storage container. During loading, lading passes from the storage container through the lading valve into the tank, and air and vapors pass from the tank to the storage container. During unloading, lading passes from the tank car through the lading valve into the container, and air and possibly vapors enter the car through the vent conduit from the atmosphere or from the top of the container. A pump and valves are provided to control the loading and unloading sequence, which may be electrically operated from a console. Thus, if desired, the operation may be carried out by a single operator controlling the console. After the car is loaded and/or unloaded, the actuating assembly is returned to a retracted position below the tracks. A unit-train of tank cars may be loaded and unloaded in this manner. A plurality of actuating assemblies may be provided to facilitate prompt loading and unloading of such a unit-train.

THE DRAWINGS

DESCRIPTION OF PREFERRED EMBODIMENTS

Figure 1:
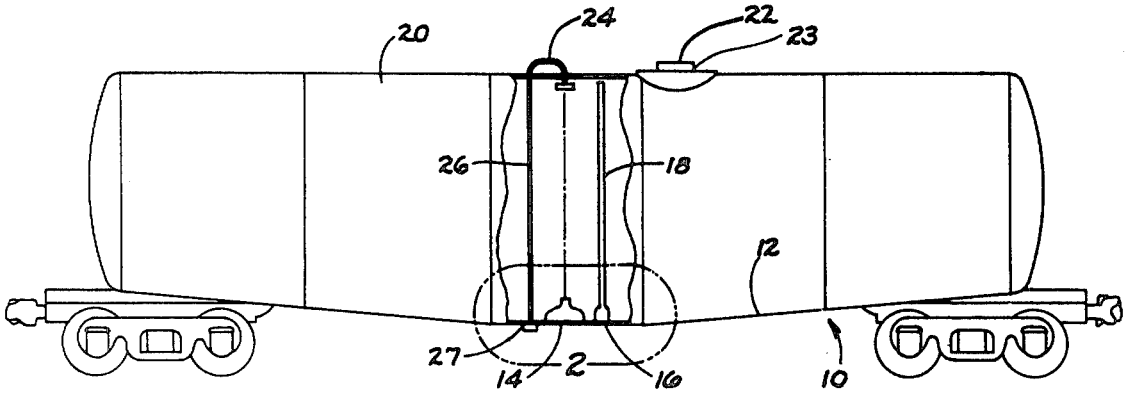
FIG. 1 is a schematic side elevation view of a railway tank car which may be utilized in accordance with the present invention.

In the drawings (FIG. 1) a railway tank car 10 includes a tank 20 with bottom 12 having a lading valve 14 and a vent valve 16 located therein. Vent valve 16 has a conduit in communication therewith 18 which extends to the top of the tank 20 above the level that the lading normally occupies. Also, in the top of the tank, a safety relief valve 22, an access manway 23 and an outage sensor 24 are provided. Safety relief valve 22 is of conventional construction and need not be further described. Outage sensor 24 has an electrical conduit 26 connected thereto passing around the outside of the tank and extending to an electrical connection panel 28 located on the external portion of the tank bottom 12. An empty car electrical sensor 27 is located on the tank bottom and is connected electrically to electrical connection 28. Alternatively, an empty car electrical sensor may be located in conduit 87.

Figure 2:
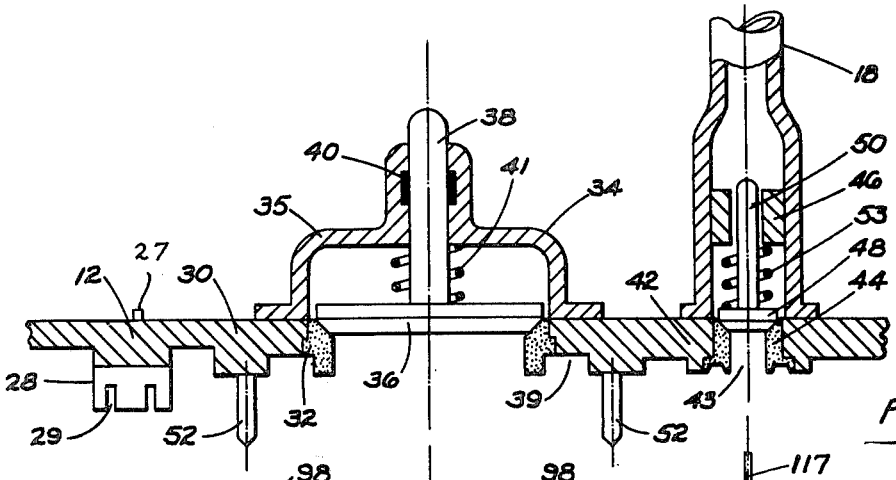
FIG. 2 is an enlarged view of the lading valve and vent valve illustrated in FIG. 1.

The tank bottom 12 (FIG. 2) further includes a mounting flange 30 to which is attached a valve seat 32 and a valve guide 34 including radially spaced arms 35 extending upwardly into the tank. A valve 36 includes a valve stem 38 extending within valve guide 34 and seal 40. A spring 41 biases the valve 36 into the closed position on valve seat 32.

Bottom 12 includes another mounting flange 42 to which is attached a vent valve seat 44. Conduit 18 is also attached to mounting flange 42, preferably by bolting. A valve guide 46 is provided in the internal surface of conduit 18. A vent valve 48 has attached thereto a valve stem 50 which moves within guide 46. A spring 53 biases the vent valve 48 into closed position.

Figure 3:
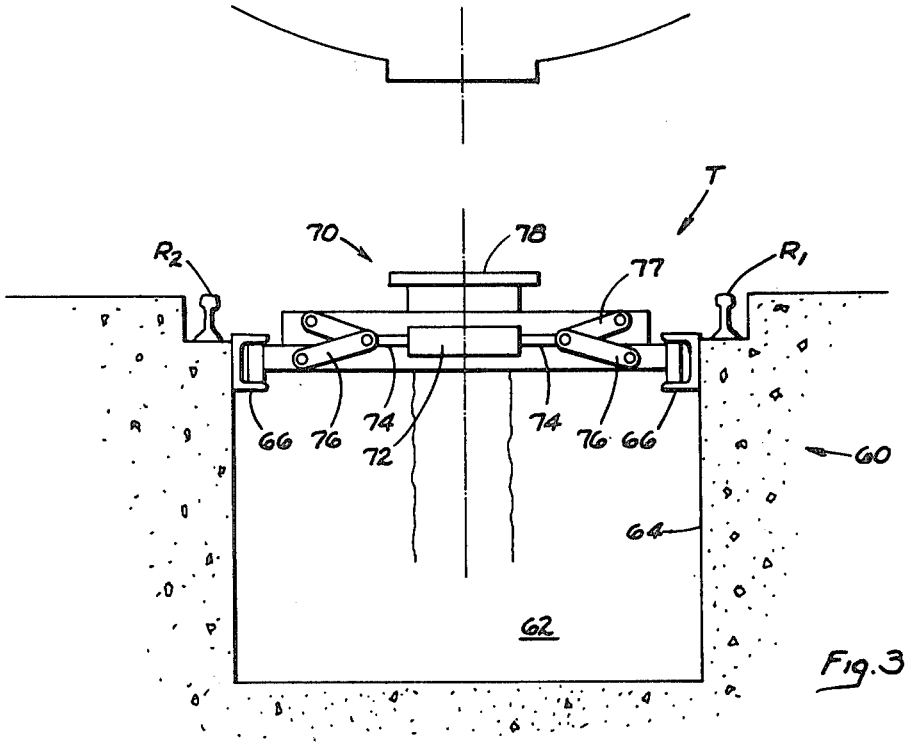
FIG. 3 is a vertical sectional view of an actuating assembly which may be utilized in accordance with the present invention.

Guide pins 52 also depend from the tank bottom. At the loading and unloading site, an actuating assembly indicated generally at 60 in FIG. 3 is provided. This unloading site 60 includes a pit 62 suitably lined at 64, located between opposite rails $R_1$ and $R_2$ of the track T. A pair of actuator supports 66 rigidly attached to pit sides 62 support a movable actuator 70. Actuator 70 includes a hydraulic cylinder 72 having a pair of pistons 74 movable therein. An extension linkage 76 is attached to the end of each piston rod 74. Such extendable linkage assemblies are known. See, for example, Martin Boot Lift ® Connector, Martin Engineering Company, U.S. Route 34, Neponset, Illinois 61345 (copy in application file). When hydraulic fluid is supplied to cylinder 72, piston rods 74 are extended which in turn extend linkage 76 from the retracted position to an extended position which moves a support plate 78 attached to linkage arms 77 upwardly.

Figure 4:
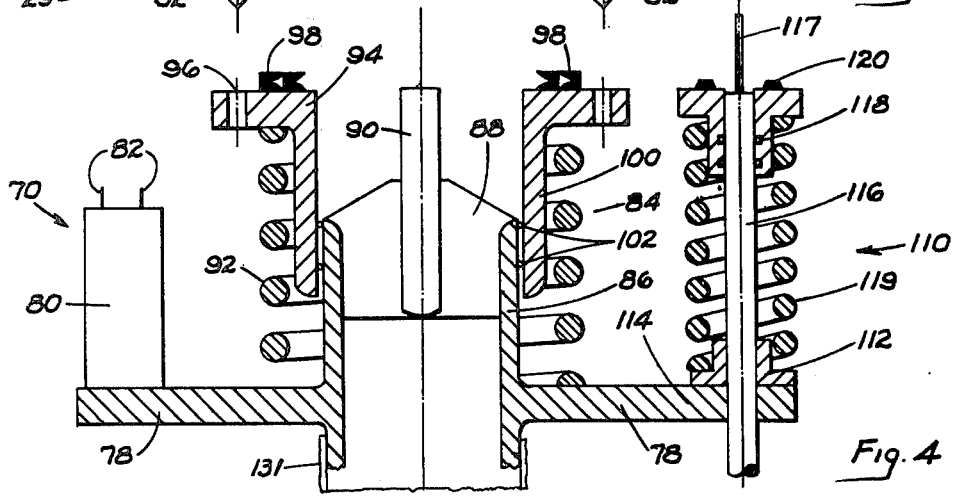
FIG. 4 is an enlarged view of the actuating assembly which may be utilized in the present invention in cooperation with the lading valve and vent valve shown in FIG. 2.

Attached to actuation support plate 78 in FIG. 4 is an electrical connection 80 having connector prongs 82 adapted to be received within electrical slots 29 in connector 28. A lading valve actuator 84 includes cylindrical conduit extension 86 to which are attached radially spaced rib supports 88.

A lading actuator pin 90 is attached to rib supports 88. A spring 92 supports a guide engagement plate 94 having slots therein 96 which receive guide pins 52 depending from the tank body. A seal 98 is provided which engages flange 30 in area 39. Actuator plate 94 includes a depending cylindrical portion 100 biased upwardly by spring 92 which is movable downwardly along actuating cylinder 86 as the actuator assembly moves upwardly after pins 52 engage plate 94. A seal 102 is provided between cylindrical portions 86 and 100.

A vent pipe actuator 110 is also mounted on plate 78. A vent pipe support 112 is held in place by welding. A vent pipe 116 extends upwardly above plate 78, and downwardly through plate 78. Vent pipe includes an actuating extension 117. A seat 118 located on the upper portion of pipe 116 is biased upwardly by spring 119 and includes a vent seal 120. When vent seat 118 engages the opening 43, and valve seat 44, pipe 116 engages vent valve 48 and vent valve 48 is moved to open position, overcoming the bias of spring 53, providing communication between vent pipe 116, conduit 18, and the upper interior of the tank.

Figure 5:
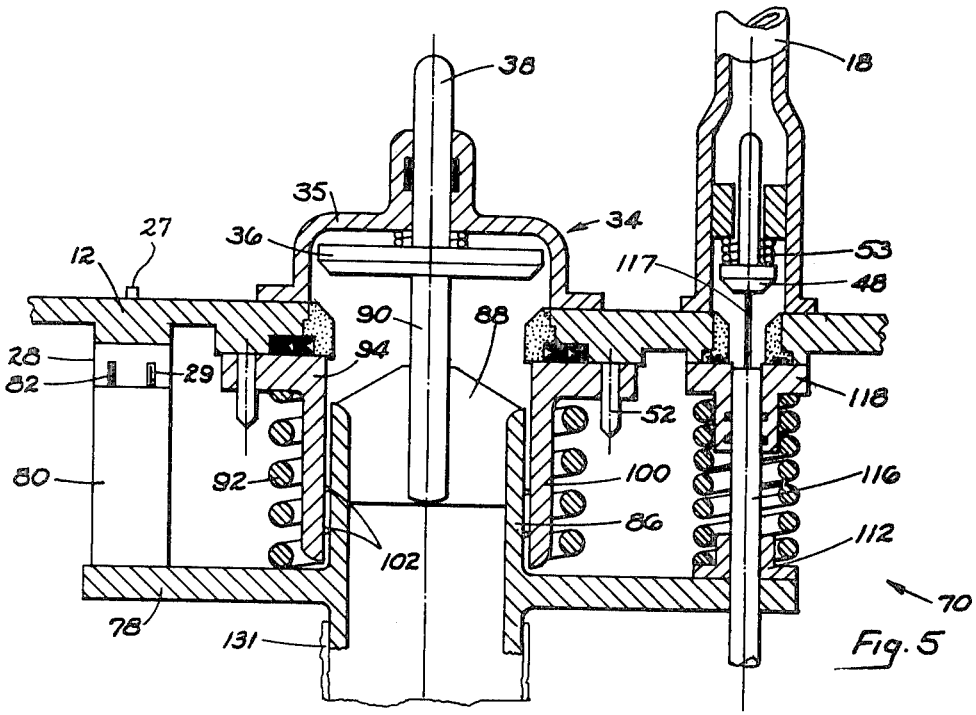
FIG. 5 is a vertical sectional view illustrating the actuating assembly 70 in engagement with the lading valve and vent valve illustrated in FIG. 2.

FIG. 5 shows the actuating assembly 70 in engaged position. Electrical connectors 82 engage slots 29 in connector 28. Pin 90 has moved valve 36 to the open position. Guides 52 have engaged slots 96 in plate 94, and support 100 has moved downwardly with respect to conduit extension 86 with spring 92 maintaining seal pressure. Lading is thus free to flow in and out through conduit extension 86 between ribs 88. Also, vent pipe 116 has moved valve 48 to the open position so that air can go in and out from the tank depending upon whether or not the tank is being loaded or unloaded.

Figure 6:
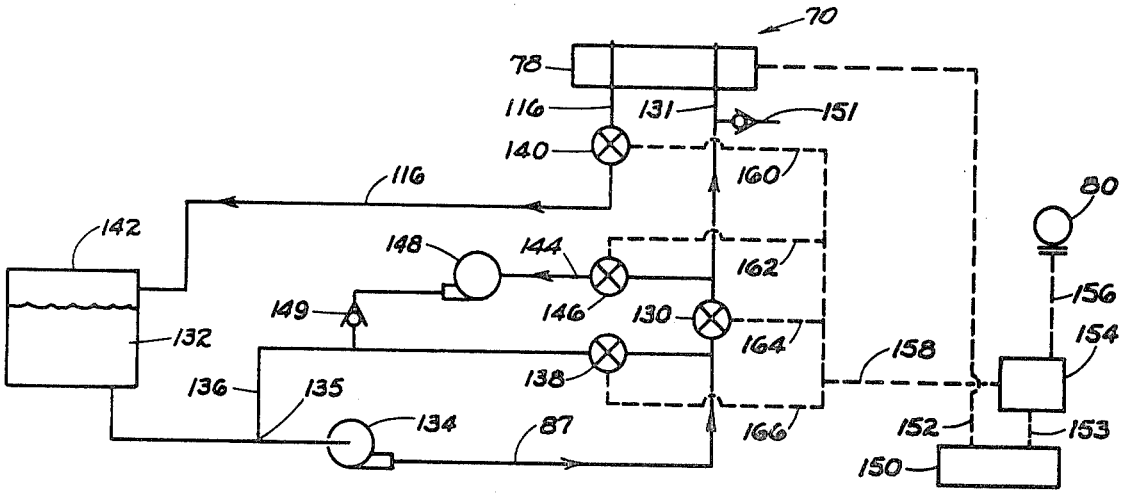
FIG. 6 is a schematic piping and valving diagram of an assembly which may be utilized to load a railway tank car according to the present invention.

FIG. 6 is a schematic illustration of the piping and valving required in the loading facility. Conduit 87 extends from storage container 132 through pump 134 and through valve 130 and by flexible conduit 131 to plate 78 of connector 70. A by-pass conduit 136 extends from conduit 87 at point 135, upstream of pump 134, through valve 138 and reconnects to conduit 87 at a point upstream of valve 130. Vent conduit 116 connects from the upper portion 142 of storage container 132 through valve 140 and flexible conduit 117 to plate 78 of connector 70. Drain conduit 144 connects to conduit 87 above valve 130 and runs through valve 146, pump 148 and directional check valve 149 connecting to conduit 136. A vacuum breaker 151 is connected in fluid communication with lading conduit 87.

An electrical control console 150 has a first control line 152 extending from the console to the actuating assembly 70 to raise and lower the same. A second control line 153 extends to a switch or relay box 154 from which a line 156 runs to the outage sensor contact 80, and control lines 158, 160, 162, 164 and 166 provide controlled opening and closing of valves 140, 146, 164 and 138 respectively.

In use of the assembly illustrated in FIG. 6 to load a railway tank car, the railroad first spots the car along the track T above the actuating assembly 60. An operator at the console 150 first activates actuating assembly 70 to supply hydraulic fluid to cylinder 72 which moves rods 74 outwardly and extends linkage 76. Depending guides 52 on the tank car then engage slots 96. Further upward movement of the assembly 70 results in the valve position shown in FIG. 5 in which pin 90 has opened valve 36 and extension 117 has opened valve 48. At the same time, from console 150, the operator closes valve 138 through and valve 146 line 166 through line 162 and opens valves 130 and 140 through respective lines 164 and 160. Pump 134 is used to pump lading from the storage container 132 into the car through conduit line 87. At the same time, air in the tank car and vapors from the lading are returned to the container through line 116.

When the tank has been filled to the desired amount, outage sensor 24 through contact 80 and console 150, closes valves 130 and 140 and opens valves 138 and 146 and starts pump 148. Since valve 130 is closed, the lading recirculates through conduit 136 and valve 138. Excess material from conduit 87 is returned through conduit 144 and pump 148 with vacuum breaker 151 allowing air to enter. The operator then retracts the assembly 70 to the position shown in FIG. 2, closing valves 36 and 48 (FIG. 5), and the loaded car is ready to move to destination.

Figure 7:
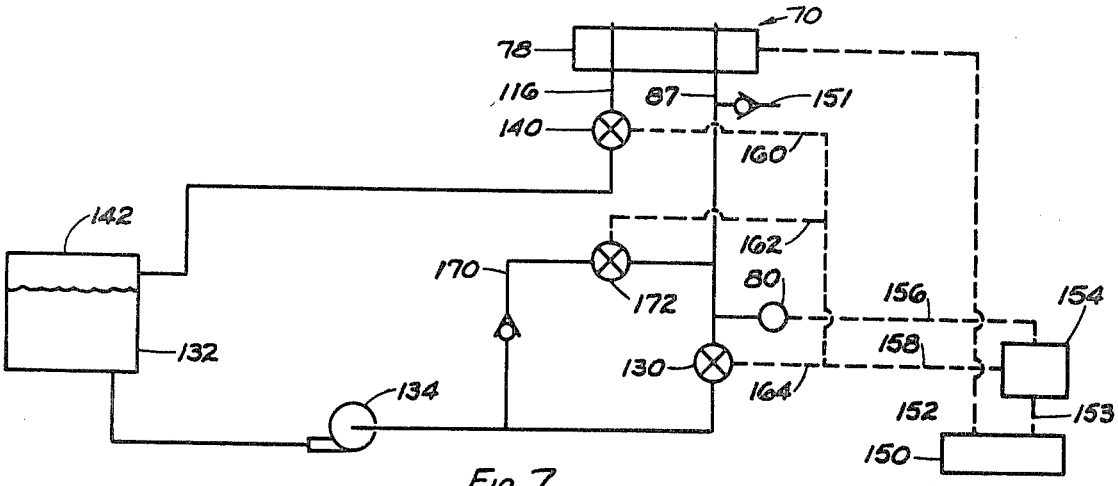
FIG. 7 is a piping and valving diagram of an assembly which may be utilized to unload a railway tank car according to the present invention.

FIG. 7 shows a piping diagram and valve assembly which may be utilized to unload a tank car according to the invention. Many elements of the unload assembly are the same as in the loading facility. A conduit 87 extends from the raising and lowering assembly 70 through pump 134 to a storage container 132. A vent line 116 likewise extends from the assembly 70 to the storage container 142. Valves 140 and 130 in these respective lines are likewise provided. A line 170 containing a valve 172 is connected as a by-pass of valve 130. Console 150 includes a connection 152 to the assembly 70 and a line 153 to the relay and contact assembly 154. A line 156 to the sensor 80 is provided and a control line 158 includes a contact line 160 to valve 140. A contact line 162 to valve 172, and a contact line 164 to valve 130 are also provided.

In the operation of the apparatus in FIG. 7 to unload a car, the railroad first spots the car over the actuating assembly 60. The operator at the console 150, through line 152, activates raising and lowering assembly 70 to raise the assembly 70 from the position shown in FIG. 4 to the position shown in FIG. 5 causing connection to be made and valves 36 and 48 to open. At the same time the operator opens valves 130 and 140 in respective product line 87 and vent line 116. The lading flows from the tank by means of product line 87 and pump 134 into the storage container 132. Air enters the tank car through line 116 connected to the upper portion 142 of the container 132, in which case vapors may also enter the tank as the car is unloaded. When the tank is empty, the sensor 27 connected to contact assembly 154 causes valves 130 and 140 to close and opens valve 172 to drain remaining lading in the line 87, with air admitted through vacuum breaker 151. The operator then lowers the assembly 70 through line 152 and the unloaded car is ready to move to a loading facility, or alternatively, is ready to be connected in the manner shown in FIG. 6 for reloading the car.

It will be apparent that the present invention has the following advantages. The railway cars including the lading valve 14, vent valve 16, safety valve 22, and sensors 24 and 27 are inexpensive. Use of the inter-connecting piping utilized by interconnected unit-trains is avoided.

Secondly, the operation can be fully automated and thus operated by a single operator. Furthermore, a single operator may be able to operate the loading and unloading of several cars at a time, each having electrical control lines connected to control console 150.

In the event that one car is defective, only that car need to be taken out of the train. This is easily and simply done by uncoupling the car in the usual manner. The conduits, conduit valves and lading and vent valves are of simple construction and are readily obtainable from available sources.

Another advantage is that the arrangement provides a completely closed load and unload system including control of toxic vapors. Both loading and unloading operating personnel in the area are not subjected to dangerous vapors.

Another safety feature is that it is not necessary for operators to climb on top of the cars for loading or unloading.

Furthermore, it is to be understood that the particular lading valves and vent valves are shown by way of example only. It will be apparent to those skilled in the art that a wide variety of lading valves and vent valves could be used in the assembly of the present invention and that suitable actuators for these devices may be provided on the actuating assembly 70.

It is also to be understood that suitable safety covers (not shown) are provided covering the lading valve, vent valve and electrical connector on the underside of the car. Furthermore, an access manway (not shown) may be provided in the top of the car. Furthermore, suitable covers (not shown) are provided over the pit area between the tracks to ensure that dirt and debris carried by the car or blown in when the car is not connected would not contaminate the lading or pit area.

What is claimed is:

1. A railway tank car loading and unloading assembly comprising: a tank body having a quick load and unload lading valve in the tank bottom; a vent valve located in the tank bottom; a vent conduit extending from the vent valve up to the top portion of the tank to a tank vent opening located in said vent conduit in the top portion of the tank; an outage sensor located in the top portion of the tank; said sensor being electrically connected to an electrical sensor connection in the tank bottom; a tank car loading and unloading actuating assembly including a lading valve actuator, a vent valve actuator and an electrical connector; a lading conduit connected between the lading valve actuator and a storage container; means for moving said actuating assembly upwardly to engage a portion of said lading valve and said vent valve, to automatically open the same, and to engage said electrical sensor connection; whereby during loading, lading passes from the storage container through the lading valve into the tank, and air and vapors pass out of the tank through said vent conduit and vent valve until said outage sensor is reached at which time the loading operation is discontinued and, during unloading, lading passes from the tank car through the lading valve into the storage container, and air and vapors enter the car through said vent valve; and means for moving means for moving said actuating assembly to a retracted position below the tracks after the car is loaded and/or unloaded.

2. A railway tank car according to claim 1 wherein said actuating assembly includes an actuating support plate and wherein said lading valve actuator and said vent valve actuator are supported by said actuating support plate.

3. A railway tank car according to claim 2 wherein an extendable linkage is attached to said support plate and wherein said linkage is movable from a retracted position when said linkage is compressed and an extended position wherein said linkage moves said support plate upwardly adjacent said tank bottom.

4. A railway tank car according to claim 3 wherein said extendable linkage is attached to a piston which is movable within a cylinder.

5. A railway tank car according to claim 5 wherein a pair of extendable linkages are provided, each attached to a piston rod, and which pistons are movable within a fluid cylinder.

6. A railway tank car according to claim 5 wherein said lading valve actuator includes a hollow cylindrical extension for lading flow therethrough and radially spaced ribs which support an actuating pin attached thereto.

7. A railway tank car according to claim 6 wherein said vent valve actuator comprises an actuating conduit attached to said support plate having an actuating extension and wherein when said actuating extension moves said vent valve into open position, said actuating conduit is in fluid communication with said vent conduit.

8. A railway tank car according to claim 6 wherein an electrical connector is attached to said support plate and wherein said electrical connection engages a sensor connection box located on said tank bottom.

9. A railway tank car according to claim 8 wherein said sensor connection is in electrical contact with a lading sensor located in the top of the tank.

10. A railway tank car loading and unloading assembly according to claim 1 wherein said actuating assembly includes a second vent conduit extending from said vent valve to said storage container.

11. A railway tank car loading and unloading facility comprising: a vertically movable actuating assembly including a lading valve actuator, a vent valve actuator, and an electrical actuator; a lading conduit attached to said lading valve actuator extending to a lading container; lading conduit valve means located in said lading conduit; a pump in fluid communication with said lading conduit adapted to pump lading from said container, through said conduit, and into said car; a vent conduit attached to said vent valve actuator and extending from said actuating assembly to said container; vent conduit valve means located in said vent conduit; a lading sensor located in the upper portion of said tank; an electrical connection extending from said sensor to an electrical sensor connection on said tank bottom; said electrical sensor connection having means for engaging said electrical actuator; an electrical control console having a first electrical connection extending from said panel to said actuating assembly; a second electrical connection extending from said console to said electrical connection on said actuating assembly; a third electrical connection extending from said console to said lading conduit valve means; a fourth electrical connection extending from said console to said vent valve means; a fifth electrical connection extending from said console to said pump, whereby said actuating assembly, said lading valve means, said vent valve means, and said pump can be controlled from said electrical console, and whereby the loading and unloading of a railway tank car can be controlled from said console.

12. A tank car loading and unloading facility according to claim 11 including a by-pass conduit connected at opposite ends to said lading conduit and by-passing said pump; a by-pass valve in said by-pass conduit; an electrical connection extending from said by-pass valve to said control console whereby said by-pass valve can be controlled by said console to allow lading to be returned to said container at the end of a loading operation.

13. A railway tank car loading and unloading facility according to claim 12 including a second by-pass conduit which by-passes said lading valve and extends to said first by-pass conduit; said second by-pass conduit including a pump and a second by-pass valve having an electrical connection extending to said console, whereby said second by-pass valve may be opened when said lading valve is closed to return lading to the container at the end of the loading operation.

14. A railway tank car loading and unloading facility according to claim 11 wherein an unloading by-pass conduit extends from said lading conduit upstream of said pump, which by-passes said lading valve and which is reconnected to said lading conduit upstream of said valve whereby after unloading said lading valve may be closed and said unloading by-pass conduit used to drain lading from said lading conduit to said container by means of said pump.

* * * * *

UNITED STATES PATENT AND TRADEMARK OFFICE

CERTIFICATE OF CORRECTION

PATENT NO. : 4,212,333

DATED : July 15, 1980

INVENTOR(S) : Robert W. Randolph

It is certified that error appears in the above-identified patent and that said Letters Patent are hereby corrected as shown below:

Column 4, line 1, delete "and valve 146"; and after 166 insert --and valve 146--
Column 5, line 57, delete "means for moving"
Column 6, line 6, "claim 5" should read --claim 4--
Column 6, line 10, "claim 5" should read --claim 4--

Signed and Sealed this

Eleventh Day of November 1980

[SEAL]

*Attest:*

SIDNEY A. DIAMOND

*Attesting Officer*

*Commissioner of Patents and Trademarks*